United States Patent [19]

Chieger et al.

[11] 4,046,278

[45] Sept. 6, 1977

[54] AIR CARGO CONTAINER

[75] Inventors: George Chieger, Birmingham; Robert B. Schwartz, Harper Woods; Tara N. Banerjea, Warren, all of Mich.

[73] Assignee: Fruehauf Corporation, Detroit, Mich.

[21] Appl. No.: 615,124

[22] Filed: Sept. 19, 1975

Related U.S. Application Data

[63] Continuation of Ser. No. 449,638, March 11, 1974, abandoned.

[51] Int. Cl.[2] ..... B65D 87/00

[52] U.S. Cl. ..... 220/1.5; 52/11; 52/282; 52/588; 220/71; 220/72; 220/83

[58] Field of Search ..... 220/71, 83, 84, 1.5; 52/588, 282, 11, 483

[56] References Cited

U.S. PATENT DOCUMENTS

| | | | |
|---|---|---|---|
| 1,672,914 | 6/1928 | Schmitt | 52/282 |
| 1,874,901 | 8/1932 | Christiansen | 220/1.5 |
| 2,605,064 | 7/1952 | Davis | 248/501 |
| 2,876,275 | 3/1959 | Schulz | 52/588 |
| 2,919,826 | 1/1960 | Richter | 220/1.5 |
| 3,047,189 | 7/1962 | Paul | 220/71 |
| 3,061,133 | 10/1962 | Reynolds | 220/83 |
| 3,338,187 | 8/1967 | Moorhead et al. | 52/588 |
| 3,375,950 | 4/1968 | Chieger | 220/1.5 |
| 3,385,182 | 5/1968 | Harvey | 52/588 |
| 3,388,514 | 6/1968 | Archinal | 52/282 |
| 3,411,261 | 11/1968 | Soddy | 52/588 |
| 3,459,326 | 8/1969 | Betjemann | 220/1.5 |
| 3,471,982 | 10/1969 | Strozewski | 52/282 |
| 3,603,054 | 9/1971 | Didry | 52/282 |

*Primary Examiner*—William T. Dixson, Jr.
*Assistant Examiner*—Allan N. Shoap
*Attorney, Agent, or Firm*—Harness, Dickey & Pierce

[57] ABSTRACT

A cargo container formed of extruded light metal framing members and cooperating panels is made in subassemblies composed of parts which are secured together primarily by riveting, the subassemblies also being secured to one another primarily by riveting, although certain key fastenings are made by welding, and parts are limitedly telescopable prior to welding, to accommodate variations resulting from manufacturing tolerances.

Fastening means for securing cargo within the container, and for securing the container against displacement in a vehicle during transportation, are integrated with rigid framing elements.

4 Claims, 7 Drawing Figures

AIR CARGO CONTAINER

This is a continuation of application Ser. No. 449,638, filed Mar. 11, 1974, now abandoned.

BACKGROUND OF THE INVENTION

Cargo containers, particularly for air transport, must be as light as possible, yet must be strong, effectively sealed when closed, easily and rigidly anchorable in position in the carrier vehicle, and must include reliable means for locating cargo against unwanted shifting in the container.

The overall object of the present invention may be summarized as to provide an improved container of the class referred to having the indicated desirable properties in high degree and which is well adapted for large-scale production and low in cost.

Other objects and advantages will become apparent upon consideration of the present disclosure in its entirety.

BRIEF DESCRIPTION OF THE FIGURES OF DRAWING

FIGS. 5 and 6 are cross-sectional views on a larger scale taken substantially on the lines V—V and VI—VI, respectively, of FIG. 4 and looking in the direction of the arrows; and FIG. 7 is a fragmentary detailed view, on a larger scale, of the portion contained within the circle designated VII in FIG. 3.

DETAILED DESCRIPTION OF PREFERRED FORM OF THE INVENTION

Figure 3:
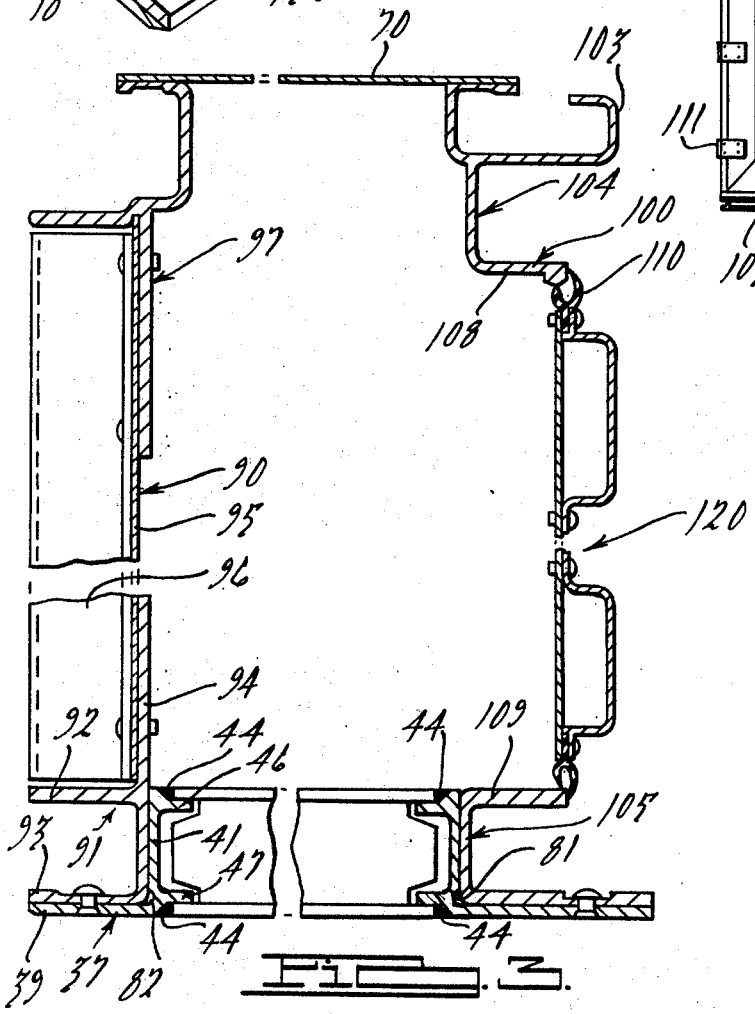
FIG. 3 is a fragmentary longitudinal section.
Figure 2:
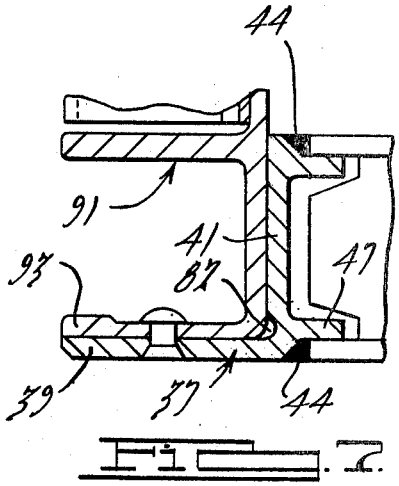
FIG. 2 is a fragmentary cross-sectional view of the container.
Figure 2:
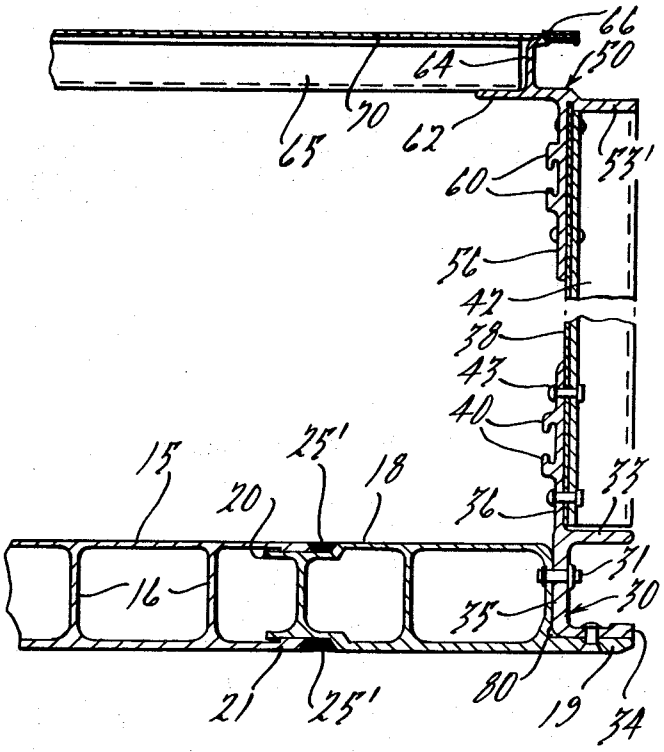
Figure 4:
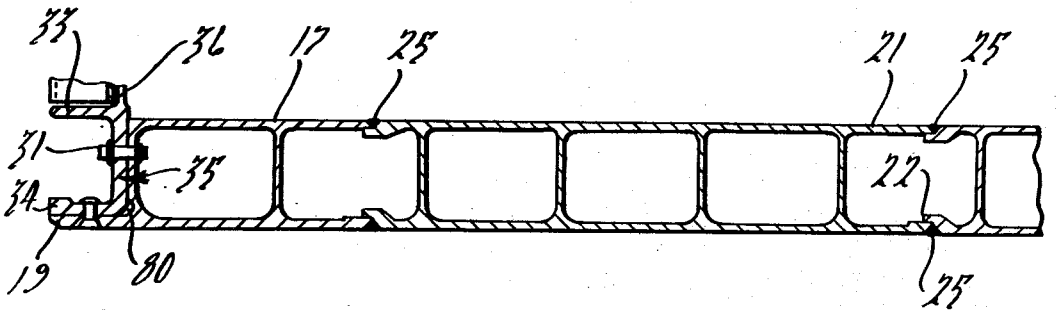
Figure 4:
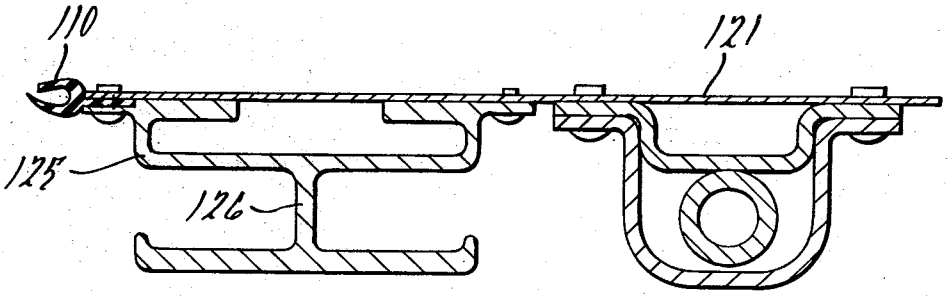
Figure 5:
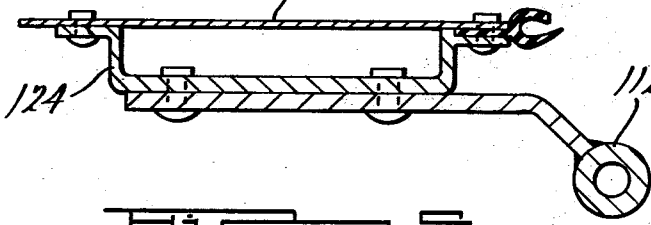
Figures 2, 4, 5:
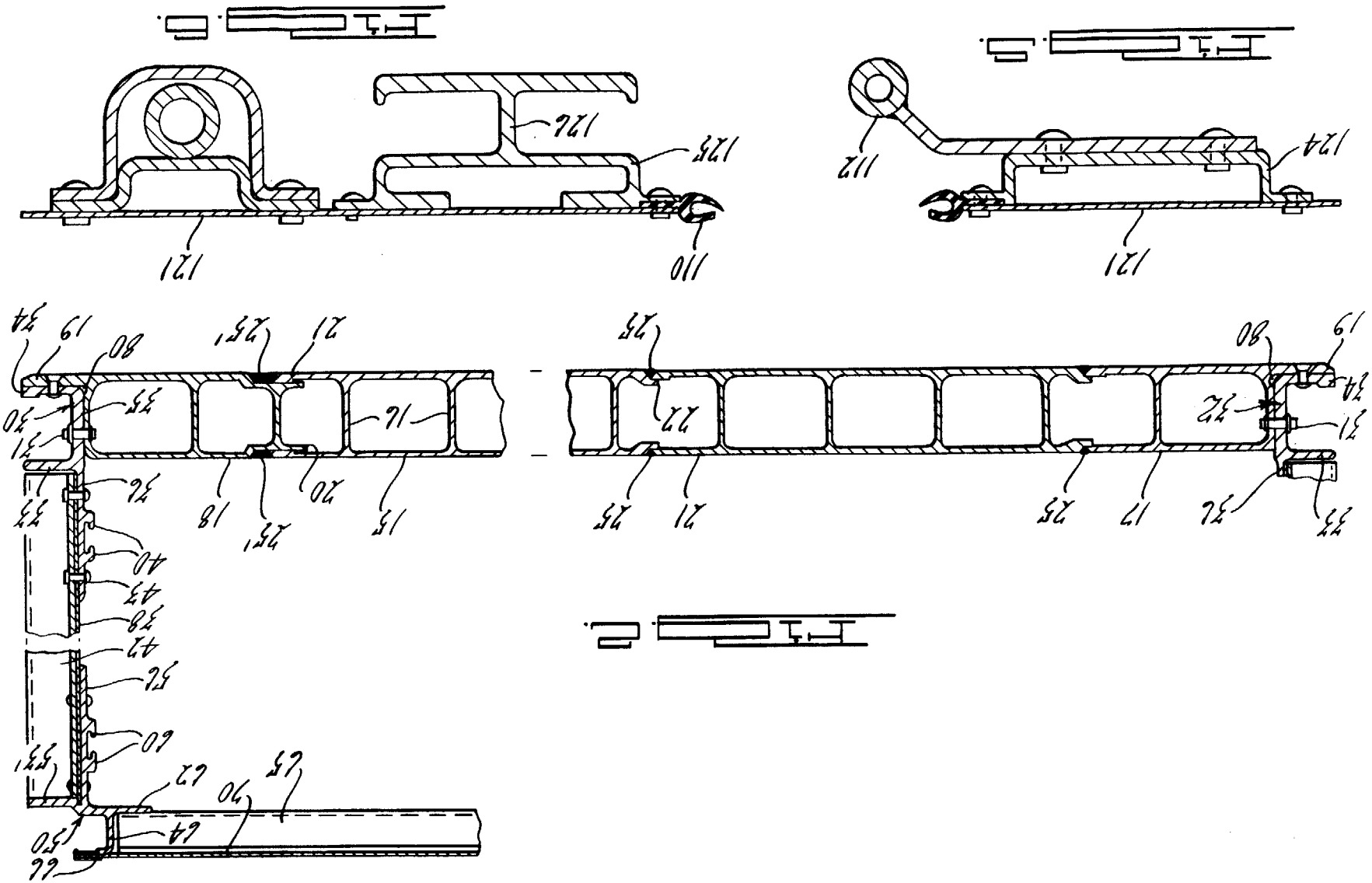

The container is constructed of subassemblies each of which, with the exception of the floor, is preassembled primarily by riveting; the floor, and the means securing the subassemblies to one another, including welded joints. The framing structure includes rails 30, 35, 50, 91, 104, 105, ribs 42, 65, 96, etc. to be further described hereinafter. The construction of the floor assembly is best illustrated in FIGS. 2 and 3. A plurality of hollow extruded aluminum box-section planks or floor boards are provided, extending longitudinally of the container, comprising mid-floor boards 15 and side edge boards 17, 18. Each floor board is formed with vertical internal stiffening webs 16.

The side edge boards, or planks 17, 18 differ from the mid or intermediate planks 15, and will be considered in greater detail hereinafter, but one (18) is provided along its inner longitudinal edge with a relatively deep tongue-defining portion 20, of reduced thickness, adapted to fit into a groove defined by spaced mating flanges 21 which form integral continuations of the flat top and bottom webs of the adjacent intermediate planks 15. Each of the intermediate planks has a similar but shallower tongue section 22 along its opposite edge, mating with the corresponding groove-defining flanges 21 of the next adjacent plank. The interfitted tongue and groove portions are adapted to be secured together by seam welding, as indicated at 25, 25'. The deeper tongue portions 20 on the edge floor board 18 permit a greater degree of telescoping movement of the parts to accommodate discrepancies due to manufacturing tolerances.

Although the floor boards are interlocked against vertical disalignment by the tongue and groove-type interfitting thereof, the tongue-defining flanges 20, 22 are inset from the top and bottom main floor surfaces by only a relatively small displacement, and such flanges are joined to the main surfaces by V-defining sloping walls. The parts are thus proportioned suitably to receive the seam welds 25, 25', which not only secure the floor boards together, but fill the depressions. Due to the telescopic adjustment which is possible by virtue of the tongue and groove effect, particularly between the longer tongue 20 and the next adjacent floor board, the transverse dimension of the floor board assembly can be adjusted prior to making the welds 25, 25', etc., to accommodate it to the desired spacing of the side rails, which is related to the finished dimensions of the front and rear wall assemblies 90–120.

In the internal corner between the outwardly extending bottom flange 19 of each of the floor board members 17, 18 and the vertical wall thereof which abuts the bight section of bottom side rail 30, 32, a longitudinal groove 80 is formed defining a pocket for sealant, and similar sealant-accommodating relieved areas 81 and 82, FIG. 3, are provided between the floor assembly and the front and rear bottom cross rails 91, 105 of the subassemblies 90, 100, respectively, which define the front and rear walls of the container, and which will be described more fully hereinafter.

Attached to the outer edge of each side floor board 17, 18 is a bottom side rail member generally designated 30, 32. Side rail 30 has a U-channel configuration consisting of longitudinally extending top and bottom outturned horizontal flanges 33, 34, and a vertical bight flange 35 the latter secured to the side floor boards by means of rivets 31. Side floor board 18 also has an integral outwardly extending horizontal bottom flange 19 which underlies and is similarly secured to bottom flange 34 of rail 30.

Figure 1:
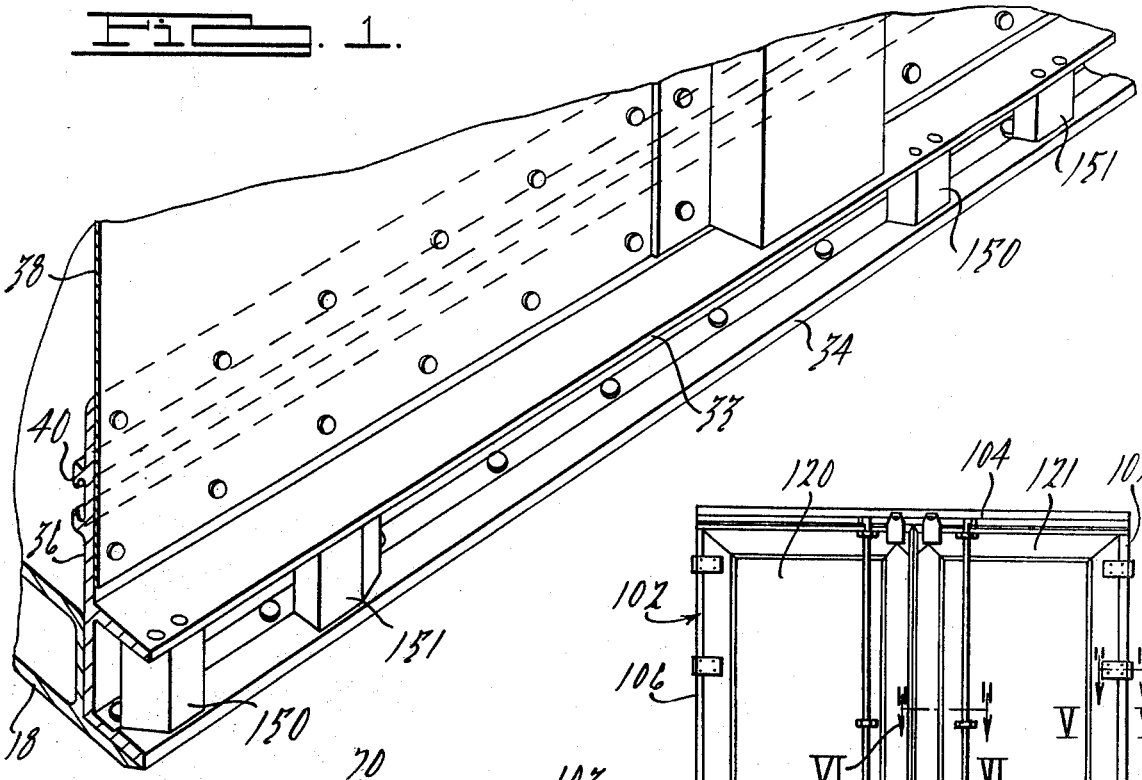
FIG. 1 is a perspective view of a portion of one side wall and the bottom side rail of a cargo container embodying the invention.

As shown in FIG. 1 the top and bottom flanges 33, 34 of the side rail 30 contain anchoring blocks as 150, 151 secured in pairs therebetween and so spaced and positioned as to receive therebetween suitable holding latch means (not shown) adapted to be projected into the space between the blocks to releasably secure the container to the carrier. These parts, and the side walls, are alike on both sides of the container, so that detailed description of one will suffice.

Extending upwardly from and substantially coplanar with the bight flange 35 of the side rail member 30 is an integral securing flange 36 which extends the full length of the container. Closure panels 38 overlie and are secured to the outer face of flange 36. The inner face of flange 36 carries integral cargo-securing means in the form of flanges 40 contoured to define a T-section cargo-securing track extending lengthwise of the container.

The parts consisting of the rail 30 and associated side wall elements just described can constitute a subassembly, as indicated previously. Such subassembly also includes a top longitudinal corner rail member generally designated 50 having a longitudinal securing flange 56, corresponding to the flange 36 previously described, extending downwardly inside the container and having on the inner face thereof integral cargo-securing track flanges 60. The rail 50 includes an outwardly extending upper flange 53 which overlies the ribs 42 and serves as a drip molding, and an inwardly extending horizontal flange 62, which is adapted to underlie and support roof cross beam members 65. A vertical longitudinal flange 64 integral with the corner member 50 extends upwardly to a relatively short out-turned top flange 66 to which the roof panel 70 is secured in sealed relation as by means of a riveted and cemented joint.

Vertical box section bracing rib members 42 are secured to the outer faces of the panels 38. Rivets for securing the same may also extend through the securing flanges 36, 56, as indicated at 43.

As best shown in FIG. 3, the front wall subassembly 90 is basically similar to the side wall subassembly previously described. The bottom rail member 91 of the front wall also includes out-turned horizontal flanges 92, 93 and an upwardly extending securing flange 94 integral with the bight flange thereof and adapted to hold the closure panel 95 and ribs 96. The top cross rail 97 of the front wall is provided with similar flanges for securing the closure panels, ribs, and roof panel 70, as shown. An angle member 37 extends entirely across and is welded to the floor assembly, and has a base flange 39 underlying and secured to the rail 91 similar to the side flange 19 previously described. The inner flange 41 of angle member 37 carries integral longitudinal tongue ribs 46, 47 which project toward the interior of the container and are spaced to fit accurately between and in telescopic relation to the top and bottom webs of the floor plank members. The reinforcing ribs 16 of the planks are grooved at their ends to provide clearance for ribs 46, 47 as indicated at 48. This telescoped interfitting permits longitudinal variation and adaptation of the effective length of the floor assembly to adjust to the finished length of the container. Ribs 46, 47 are welded to the ends of the floor boards 15, 18, as indicated at 44 in the adjusted-length position.

The rear wall assembly 100 includes a hollow rectangular frame generally designated 102 for the double doors 120, 121. The frame includes a top header 104, a bottom sill 105, and vertical side jambs 106, 107. An open-topped channel-defining portion 103 of the header 104 defines a rain gutter lying behind the roof panel and is open at the sides of the container to divert from the doorway water flowing off the roof. The sill 105 is attached to the floor subassembly by means of a securing angle member 49 corresponding to member 41 and having telescopable and welded tongue ribs at 45 secured to the flooring by welds 44 in a manner similar to the attachment of the front wall assembly previously described. Gasketing 110 on the doors is in sealing engagement with the header and sill flanges 108, 109 and with the jambs 106, 107 when the doors are closed. Jambs 106, 107 carry hinge butt portions 111 which coact with hinge butt portions 112 on the doors. Each door consists of a panel as 122 bounded around its top, bottom and hinged edges by a double-bent U-shaped stiffening member 124. The free vertical edge of each of the doors, which meet at the center, have a marginal stiffening member 125 corresponding to and forming a continuation of the member 124, but strengthened by the addition of an integral T-section 126.

The doors are adapted to be locked to the header and sill members 104, 105 by any suitable locking means, which may correspond to the disclosure of the U.S. patent application of Adam D. Sweda, Ser. No. 238,567, filed Mar. 27, 1972.

This Detailed Description of Preferred Form of the Invention, and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent Office.

What is claimed is:

1. In a cargo container or the like including spaced parallel walls and frame means supporting the same in fixedly spaced relation, a floor assembly extending between said walls and comprising box section planking having spaced top and bottom webs, said frame means including a bottom rail structure extending along the base of at least one of said walls and said rail structure including a U-channeled portion having a vertical bight part, a flange formed as an integral upward extension of the bight part, the wall being secured to said flange, said web flanges of said U-channeled portion extending horizontally outwardly under the bottom of said wall, said structure also having additional flanges extending horizontally inwardly in the opposite direction from said side web flanges and telescopically fitted between and welded to said top and bottom webs of said planking to support said floor assembly, the floor assembly comprising hollow planks having internal reinforcing ribs extending longitudinally therein perpendicularly to said top and bottom webs and to said wall and recessed to accommodate said additional flanges.

2. In a cargo container or the like including spaced parallel walls and frame means supporting the same in fixedly spaced relation, a floor assembly extending between said walls and comprising box section planking having spaced top and bottom webs, said frame means including a bottom rail structure extending along the base of at least one of said walls and said rail structure including a U-channeled portion having a vertical bight part, a flange formed as an integral upward extension of the bight part, the wall being secured to said flange, side web flanges of said U-channeled portion extending horizontally outwardly under the bottom of said wall, said structure also having additional flanges extending horizontally inwardly in the opposite direction from said side web flanges and telescopically fitted between and welded to said top and bottom webs of said planking to support said floor assembly, said bottom rail structure comprising two elements, one of said elements comprising the U-channeled portion and the first-mentioned flange, and the other element having a vertical wall carrying said additional flanges and lying against the inner face of the bight part, said other element also having a bottom flange wall underlying and secured to the bottom web flange of the first-mentioned element.

3. In a cargo container or the like having a framing structure, spaced parallel longitudinally extending bottom side rail members forming a part of such framing structure and each including a U-channeled portion comprising a flat vertical bight flange and integral horizontally out-turned vertically spaced longitudinally extending parallel flat web flanges, an upwardly projecting flat panel holding flange integral and substantially coplanar with the bight flange of each of said rail members, a wall panel secured to the outer surface of each of said upwardly projecting flanges, cargo securing means carried by and integral with the panel holding flange on the inner surface thereof, floor means extending between and secured to said rail members throughout the length thereof, said floor means having side edge wall portions abutting and secured to the bight flange and having a bottom wall projecting under and secured to the lowermost web flange, a top side rail member including a horizontal outturned flange, a horizontal inturned roof supporting flange, and a downwardly extending vertical panel holding flange.

4. A combination as defined in claim 3 wherein the wall panel overlies and is secured to both panel holding flanges, and vertical ribs overlying the panel and secured through the panel to the panel holding flanges.

* * * * *

UNITED STATES PATENT AND TRADEMARK OFFICE

CERTIFICATE OF CORRECTION

PATENT NO. : 4, 046, 278

DATED : September 6, 1977

INVENTOR(S) : George Chieger et al.

It is certified that error appears in the above-identified patent and that said Letters Patent are hereby corrected as shown below:

Sheets 1 and 2 of the patent are modified in accordance with the attached reproductions by the addition and correction of reference numerals.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*

Figure 4:
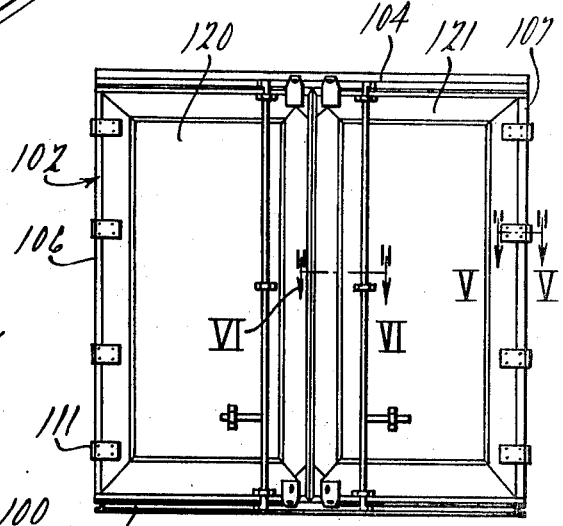
FIG. 4 is a rear elevational view of the container.

FIG. 1.
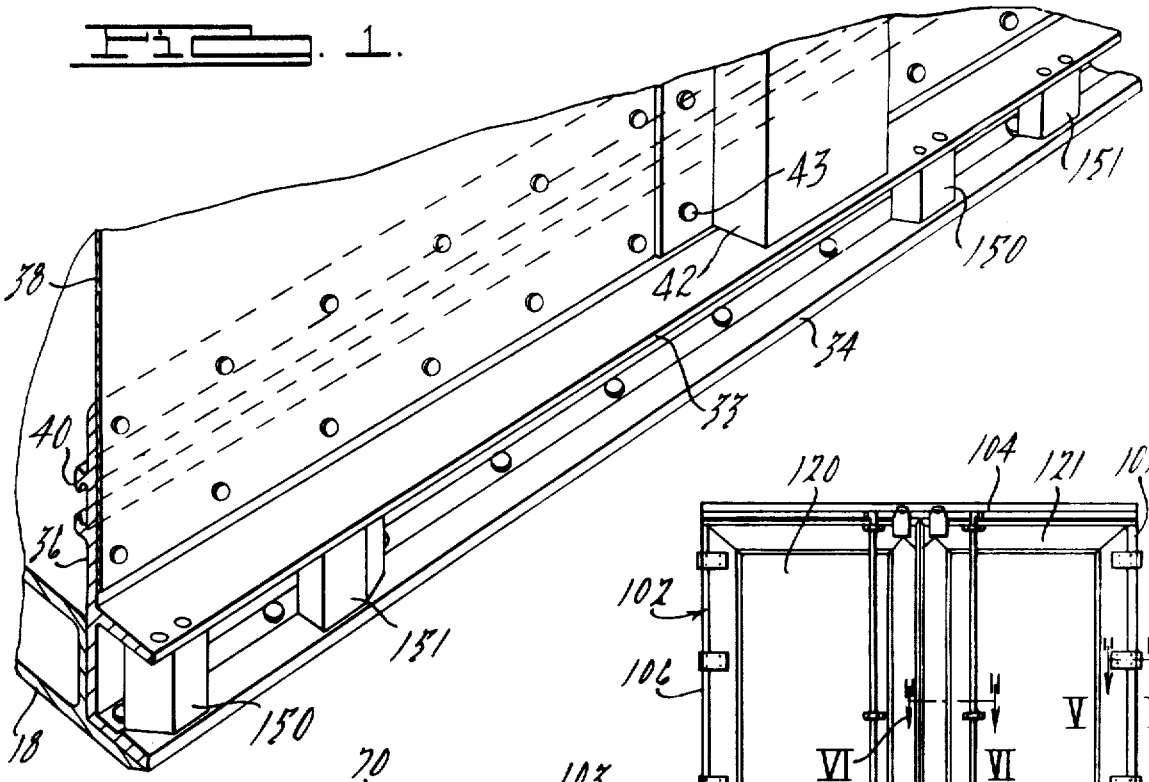
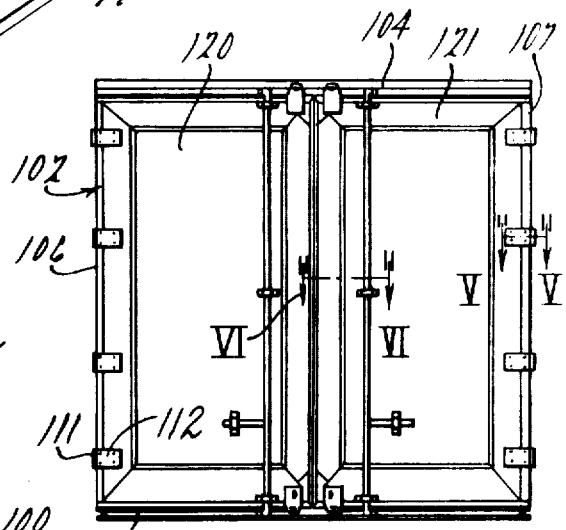
FIG. 4.
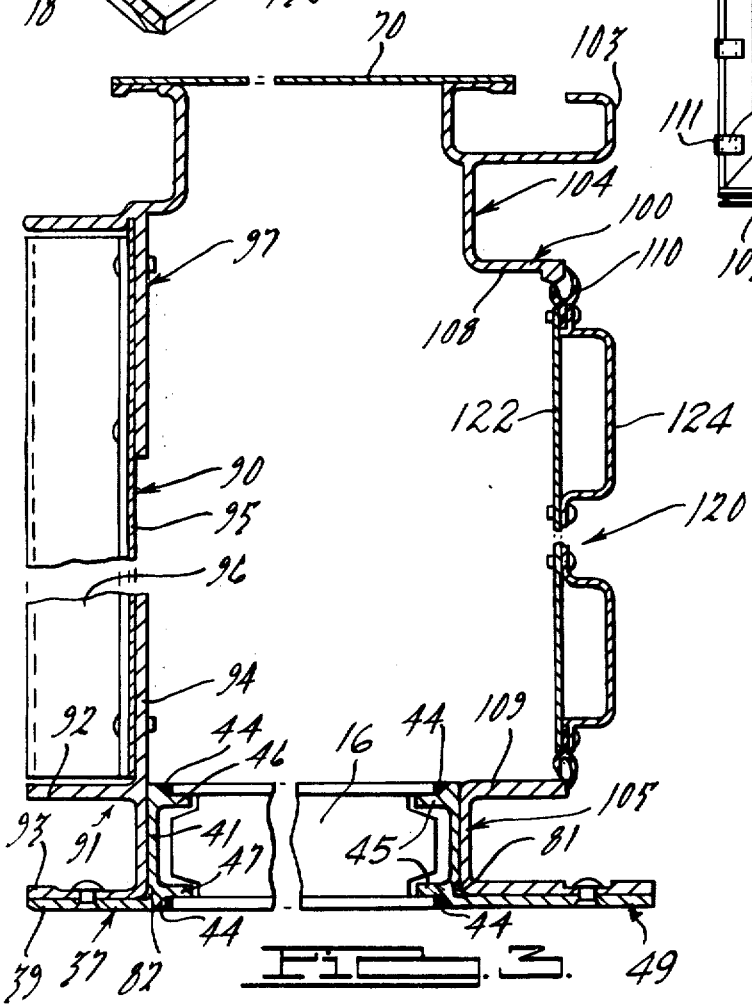
FIG. 3.
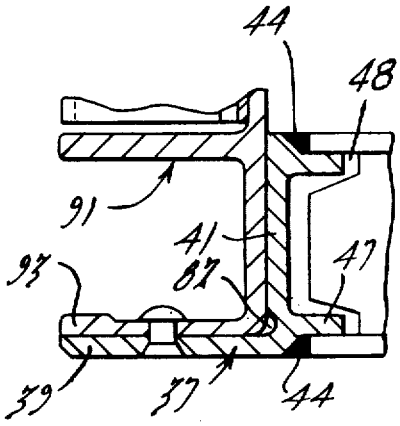
FIG. 2.